US007908809B2

(12) United States Patent
Meier

(10) Patent No.: US 7,908,809 B2
(45) Date of Patent: Mar. 22, 2011

(54) SCREEDING APPARATUS AND SYSTEM FOR A THREE DIMENSIONAL PANEL

(75) Inventor: Franz Meier, Mt. Pleasant, SC (US)

(73) Assignee: Titan Atlas Manufacturing, NY, NY (US)

( * ) Notice: Subject to any disclaimer, the term of this patent is extended or adjusted under 35 U.S.C. 154(b) by 695 days.

(21) Appl. No.: 11/954,248

(22) Filed: Dec. 12, 2007

(65) Prior Publication Data

US 2008/0202052 A1 Aug. 28, 2008

Related U.S. Application Data

(60) Provisional application No. 60/870,039, filed on Dec. 14, 2006.

(51) Int. Cl.

| | |
|---|---|
| ***E04B 1/20*** | (2006.01) |
| ***E04B 2/00*** | (2006.01) |
| ***E04B 1/02*** | (2006.01) |
| ***E04C 5/16*** | (2006.01) |

(52) U.S. Cl. ..... 52/367; 52/741.1; 52/319; 52/426; 52/565; 52/677

(58) Field of Classification Search ..... 52/364–372, 52/375–376, 741.1, 741.41, 747.12, 319, 52/321–322, 426, 565, 677–678, 684, 689, 52/699; 404/47, 48, 56

See application file for complete search history.

(56) References Cited

U.S. PATENT DOCUMENTS

| | | | | |
|---|---|---|---|---|
| 2,036,054 | A * | 3/1936 | Knapp | 52/220.1 |
| 2,345,976 | A * | 4/1944 | Hillberg | 52/678 |
| 2,676,483 | A * | 4/1954 | Nelsson | 52/242 |
| 2,867,041 | A * | 1/1959 | McMillan | 33/228 |
| 3,006,115 | A * | 10/1961 | Hillberg | 52/365 |
| 3,430,407 | A * | 3/1969 | Berry | 52/689 |
| 3,471,987 | A * | 10/1969 | Yelsma | 52/684 |
| 4,115,976 | A * | 9/1978 | Rohrer | 52/745.05 |
| 4,158,937 | A * | 6/1979 | Henry | 52/365 |
| 4,669,245 | A * | 6/1987 | Lucas | 52/370 |
| 4,765,105 | A * | 8/1988 | Tissington et al. | 52/309.11 |
| 5,301,485 | A * | 4/1994 | Shaw et al. | 52/678 |
| 5,433,051 | A * | 7/1995 | Johansson | 52/367 |
| 5,850,714 | A * | 12/1998 | Liem | 52/293.3 |
| 6,178,716 | B1 * | 1/2001 | Chen | 52/678 |
| 6,223,495 | B1 * | 5/2001 | Shaw et al. | 52/749.1 |
| 6,279,274 | B1 * | 8/2001 | Amiet et al. | 52/125.2 |
| 6,598,364 | B1 * | 7/2003 | Pelles | 52/396.02 |
| 6,719,486 | B2 * | 4/2004 | Craghan | 404/119 |
| 6,729,585 | B2 * | 5/2004 | Ogden | 248/58 |
| 6,854,232 | B2 * | 2/2005 | Snauwaert | 52/582.1 |
| 6,910,309 | B2 * | 6/2005 | Trangsrud | 52/685 |
| 7,192,216 | B2 * | 3/2007 | Casale | 404/118 |
| 2002/0026760 | A1 * | 3/2002 | Moore, Jr. | 52/309.11 |
| 2006/0008324 | A1 * | 1/2006 | Metrock | 404/118 |
| 2007/0137135 | A1 * | 6/2007 | Shymkowich | 52/698 |
| 2008/0134618 | A1 * | 6/2008 | Ferro De La Cruz | 52/689 |

* cited by examiner

*Primary Examiner* — Richard E Chilcot, Jr.
*Assistant Examiner* — Mark R Wendell
(74) *Attorney, Agent, or Firm* — Schmid PA

(57) ABSTRACT

Disclosed is both an apparatus and system for screeding a three dimensional panel including a screed clip for securing a guide bar to the panel for screeding a cementitious coating to a substantially uniform finish and level. The clips are used in combination and in series to support a guide bar. The clips are attached to the wire grid mats of a three dimensional panel to enable a less than skilled laborer to finish a cementitious coating applied to the panel.

25 Claims, 7 Drawing Sheets

SCREEDING APPARATUS AND SYSTEM FOR A THREE DIMENSIONAL PANEL

RELATED APPLICATION

This application relies upon U.S. Provisional Patent Application Ser. No. 60/870,039, filed Dec. 14, 2006, the contents of which are incorporated herein in their entirety.

TECHNICAL FIELD

The present invention relates to an apparatus and system for screeding a three dimensional panel and in greater detail the apparatus and system includes a screed clip for securing a guide bar to the panel for screeding a cementitious coating to a substantially uniform finish and level.

BACKGROUND

Buildings have commonly been formed from various prefabricated elements. One common prefabricated building element includes a three dimensional panel used to form portions of a finished structure. The paneled element typically includes a three-dimensional grid body having an insulating body formed within the grid, which is then finished with an application of a cementitious coating such as shotcrete.

In greater detail, the three dimensional panel includes two parallel welded wire grid mats and associated web wires holding the wire grid mats at a distance from one another. An insulating body is arranged between the wire grid mats. The web wires extend through the insulating body and support it between the wire grid mats. To improve the adhesion of the concrete to the insulating body, the insulating body may include roughened surfaces. A cementitious coating of shotcrete is then applied to the panels to complete the structure.

Unfortunately, while the panel process of building provides a strong and quick method for forming a structure, it does require a relatively skilled and experienced craftsperson to hand finish the applied concrete to a desired thickness and finish. Thus, it would be desirable to accelerate the building process and reduce costs if the finishing process of applying the shotcrete could be done quickly using unskilled labor.

SUMMARY

The present invention includes both an apparatus and system for screeding a cementitious coating applied to a three dimensional panel. The screeding system includes a screed clip for securing a guide bar to the panel for screeding a cementitious coating to a substantially uniform finish and level. The clips are used in combination and in series to support a guide bar. The clips are attached to the wire grid mats of the three dimensional panels to enable a less than skilled laborer to finish a cementitious coating applied to the panel.

In greater detail, the screed clip of the present invention is used in combination with a three dimensional panel. The three dimensional panel is formed from two opposed parallel welded wire grid mats, an insulating body arranged between the wire grid mats and associated web wires holding the wire grid mats at a distance from one another. The screed clip includes a first opposed arm and a second opposed arm extending from a base portion. The arms include at their end portions an attachment mechanism for engaging a rung of wire of the welded grid mat. An additional attachment mechanism may be located at the base portion for engaging the wire of the welded grid mat. The clip further includes a support member extending up from the base portion for engaging a guide bar.

The wire attachment mechanism can include a slotted groove for engaging the wire and a return formed at the base of the slotted groove for securely attaching the clip to the wire grid mat. The attachment mechanism may be further comprised of friction fit notches, clips, biased members, hooked members, tensioned members and combinations thereof.

The support member of the clip may include a slide portion upon which the guide bar rests and substantially parallel arms extending up from the slide portion and perpendicular to the grid mat for restricting the lateral movement of the guide bar. The arms may extend up to a length that is less than the circumference of the guide bar such that only the guide bar engages the screed.

An additional embodiment includes a kit for screeding a cementitious coating applied to a three dimensional panel. The kit includes a guide bar formed from such materials as a fiber reinforced polymer. The kit further includes a plurality of screed clips attached to the welded grid mat in series for supporting the guide bar throughout the length of the guide bar.

A further embodiment includes a method of screeding a cementitious coating applied to a three dimensional panel. The method includes attaching to the welded grid mat a plurality of screed clips comprising a first opposed arm and a second opposed arm extending from a base portion, a wire attachment mechanism located at an end portion of each arm for engaging a wire of the welded grid mat and a support member extending up from the base portion, wherein the screed clips are attached in series.

The method further includes inserting a guide bar through the plurality of screed clips attached in the series and applying a cementitious coating to the panel. The method then includes screeding the cementitious coating applied to the panel to a finish and thickness as directed by the guide bars. Additionally, the method may include removing the guide bars after screeding the cementitious coating.

DRAWINGS

DETAILED DESCRIPTION

Figure 1:
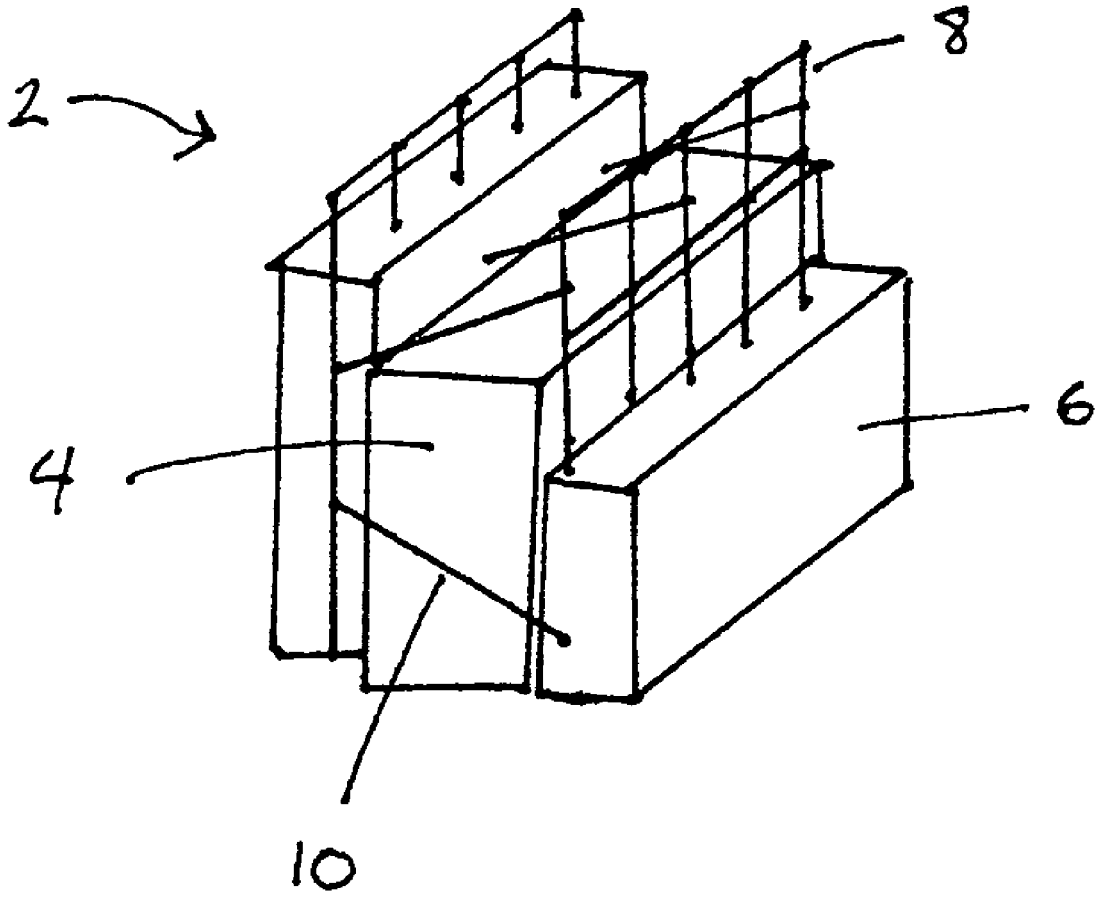
FIG. 1 is an interior cross sectional view of a three dimensional panel having an insulating foamed body formed within, and further including a shotcrete finished applied to the exterior portion of the panel.

Disclosed is an apparatus and system for screeding a cementitious coating applied to a three dimensional panel.

The system includes a screed clip for securing a guide bar to the panel's wire grid mat for enabling a less than skilled laborer to screed a cementitious coating to a substantially uniform finish and level.

The screed clips of the present system are used in combination with three dimensional panels comprised of a three dimensional welded wire frame utilizing a truss for stress transfer and stiffness. The surface of the wire grid mat, in an embodiment, is comprised of about 2 inch square welded wire mesh patterns of intersecting longitudinal and transverse wires having the same diameter. The three dimensional panel is formed from two such wire grid mats sandwiching an insulating body arranged between the wire grid mats and associated web wires holding the wire grid mats at a distance from one another.

The screed clip of the present system includes a first opposed arm and a second opposed arm extending out from a base portion of the clip running parallel to the wire grid. The arms include at their end portions farthest from the base portion an attachment mechanism for engaging a rung of wire of the welded grid mat. The clip further includes a support member extending up from the base portion for engaging and holding a guide bar in place.

The present invention further includes a kit for screeding a cementitious coating applied to a three dimensional panel. The kit provides a guide bar formed preferably from a substantially non-corrosive material, such as a fiber reinforced polymer or stainless steel. An example guide bar includes a fiber reinforced polymer bar having a diameter of ⅜ inches, this diameter was found to provide a degree of stiffness; allowing the bar to break before it bends. Of course, the guide bar is not limited to any one type of material or diameter, but can be chosen for the performance characteristics of the material, and is not limited to only non-corrosive materials. Desirable characteristics may include the ability to withstand corrosion, weight, and substantial lack of flexibility. The guide bar should be able to direct a screed to create a finish having a substantially even depth and appearance.

The kit further includes a plurality of screed clips attached to the welded wire grid mat in series for supporting the guide bar throughout the length of the guide bar. In this configuration, the screed clips are lined up in a series and in a row throughout the length of a particular guide bar. Each guide bar in this embodiment has its own respective series of screed clips attached to the grid mat. The grid mat may have a plurality of screed clip series attached in rows on the grid mat with their respective guide bars attached thereto.

A further embodiment includes a method of screeding a cementitious coating applied to the three dimensional panel. The method includes attaching to the welded grid mat a plurality of screed clips via the attachment mechanism on each clip in a series on the grid mat. The method further includes inserting a guide bar through the plurality of screed clips attached in the series and applying a cementitious coating to the panel. The application of the cementitious coating can be done through any know method including dry or wet shotcrete applications to a prescribed thickness. The method then includes screeding the cementitious coating applied to the panel to a finish and thickness as directed by the guide bars. Additionally, the method may include removing the guide bars after screeding the cementitious coating.

Referring now in greater detail to the drawings in which like numerals indicate like items throughout the several views, FIGS. 1-7 depict the present apparatus and system for screeding and finishing a cementitious coating of a three dimensional in the various embodiments of the present invention.

FIG. 1 depicts an interior cross sectional view of a three dimensional panel 2 comprising an insulating foamed body 4 formed within, and further including a shotcrete finish 6 applied to the exterior portion of the panel 2. FIG. 1 further depicts the welded wire grid mats 8 and the individually welded internal truss wires or diagonals 10 extending through the panel's foamed core 4 between each grid mat 8. The truss wires 10 are welded continuously with the grid mats 8 into a triangulated truss system for increased panel strength.

Figure 2:
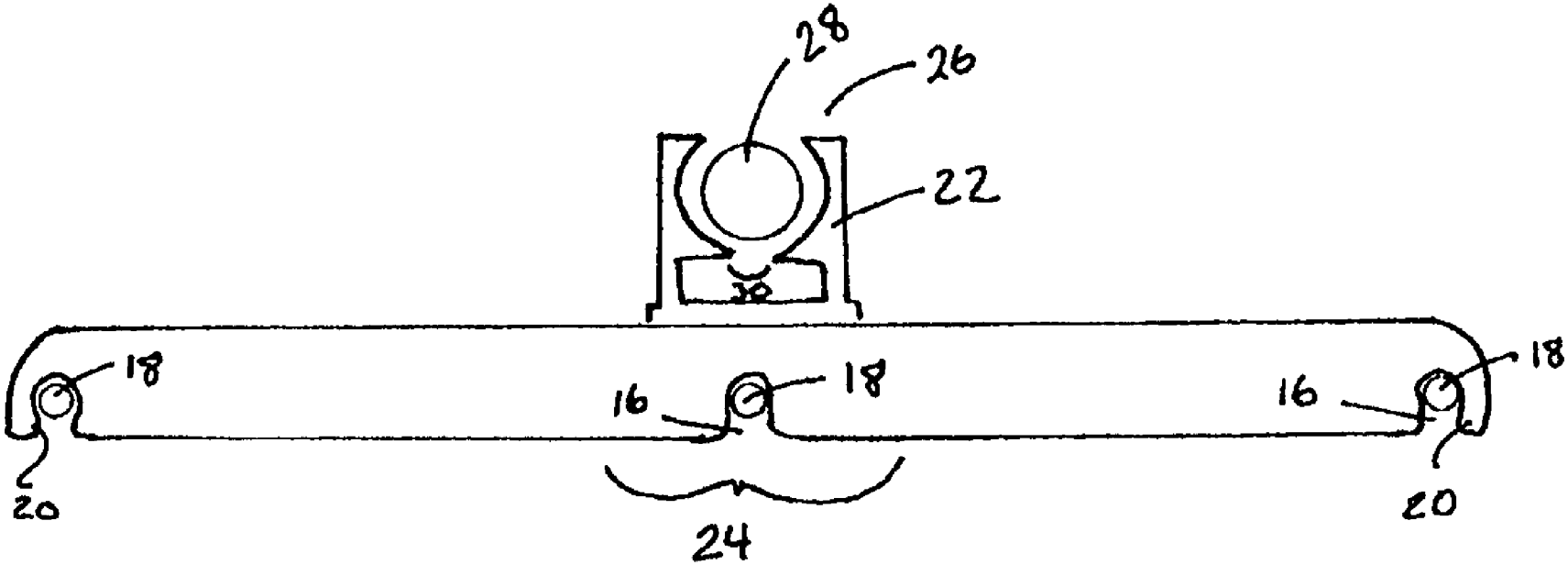
FIG. 2 illustrates a frontal view of the present screed clip including the opposed arms extending out from the base portion having attachment mechanisms within both the arms and base portion; and the support member extending up from the base portion.

FIG. 2 illustrates a frontal view of the present screed clip 12 including the opposed arms 14(*a-b*) extending out from the base portion 24 having attachment mechanisms 16 within the arms and base portion. The support member 26 extends up from the base portion 24 for engaging the guide bar 28. As shown in FIG. 2, the attachment mechanism 16 may also be located at the base portion 24 for engaging the wire 18 of the welded grid mat 8. The wire attachment mechanism 16 can include a slotted groove 16 for engaging the wire 18 and a return 20 formed at the base of the slotted groove 16 for securely attaching the clip 12 to the wire grid mat 8.

The present clip 12 is not limited to any certain number of attachment mechanisms 16 and it is contemplated that two or more attachment mechanisms 16 may be incorporated into the clip 12. For example, the opposed extended arms 14 (*a-b*) may each be attached to two adjacent wires 18 or the clip 12 may extend over three rows of wires such that each arm 14(*a-b*) and the base portion 24 are attached to individual wires 18. Of course there are other configurations involving more wires 18. The attachment mechanism 16 may be further comprised of friction fit notches, clips, biased members, hooked members, tensioned members and combinations thereof.

The support member 26 of the clip 12 may include a slide portion 30 upon which the guide bar 28 rests and substantially parallel arms 22 extending from the slide portion 30 for restricting the lateral movement of the guide bar 28. As shown in FIG. 2, the arms 22 may extend up to a length that is less than the circumference of the guide bar 28 such that only the guide bar 28 engages the screed.

Figure 3:
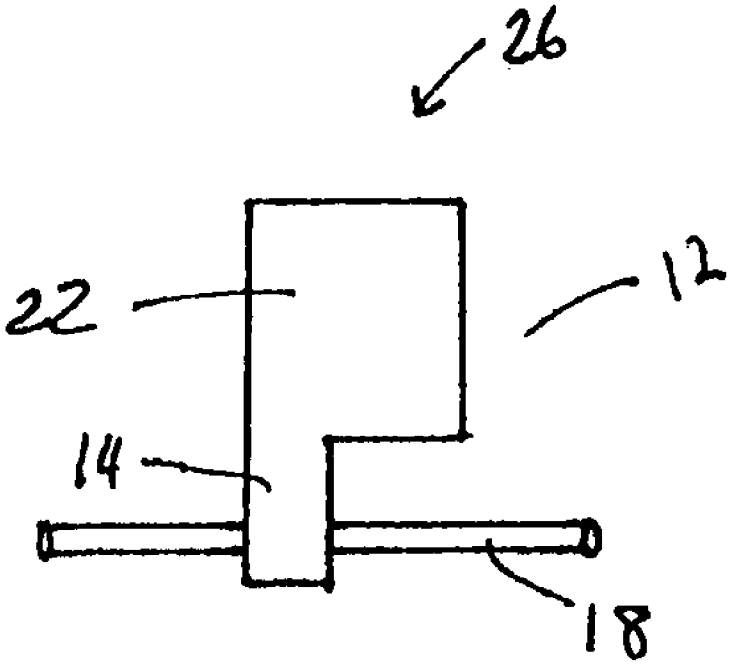
FIG. 3 depicts a side view of the clip as is would appear when perpendicular to the attached wire of the wire grid mat.

FIG. 3 depicts a side view of the screed clip 12 as is would appear when perpendicular to the wire 18 it is attached to on the wire grid mat 8. The side view of FIG. 3 illustrates one of the parallel arms 22 extending from the slide portion 30 for restricting the lateral movement of the guide bar 28 and the end portion of one of the opposed arms 14 of the clip 12. Further illustrated is a wire 18 of the wire grid mat 8 engaged with the attachment mechanism 16.

Figure 4:
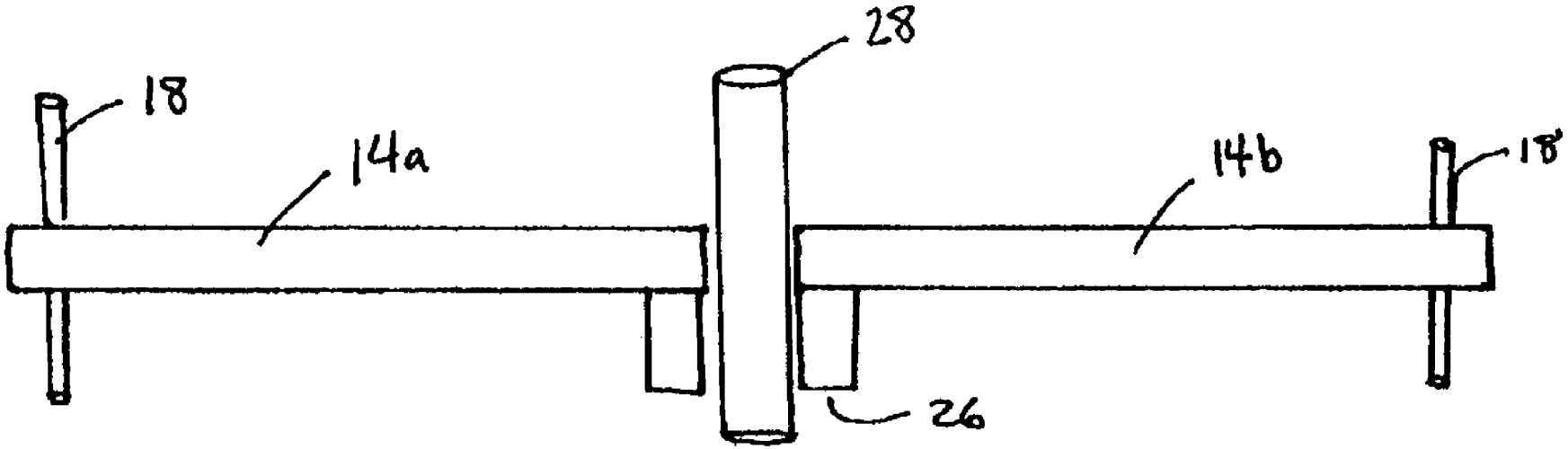
FIG. 4 illustrates a top view of the present screed clip attached to the wire grid mat.

FIG. 4 illustrates a top view of the present screed clip 12 attached to the wire grid mat 8 of the panel 2. As shown in FIG. 4, the guide bar 28 is engaged with the support member 26 and the wires 18 of the grid mat 8 are engaged with the attachment mechanisms 16 on the respective opposed arms 14(*a-b*).

Figure 5:
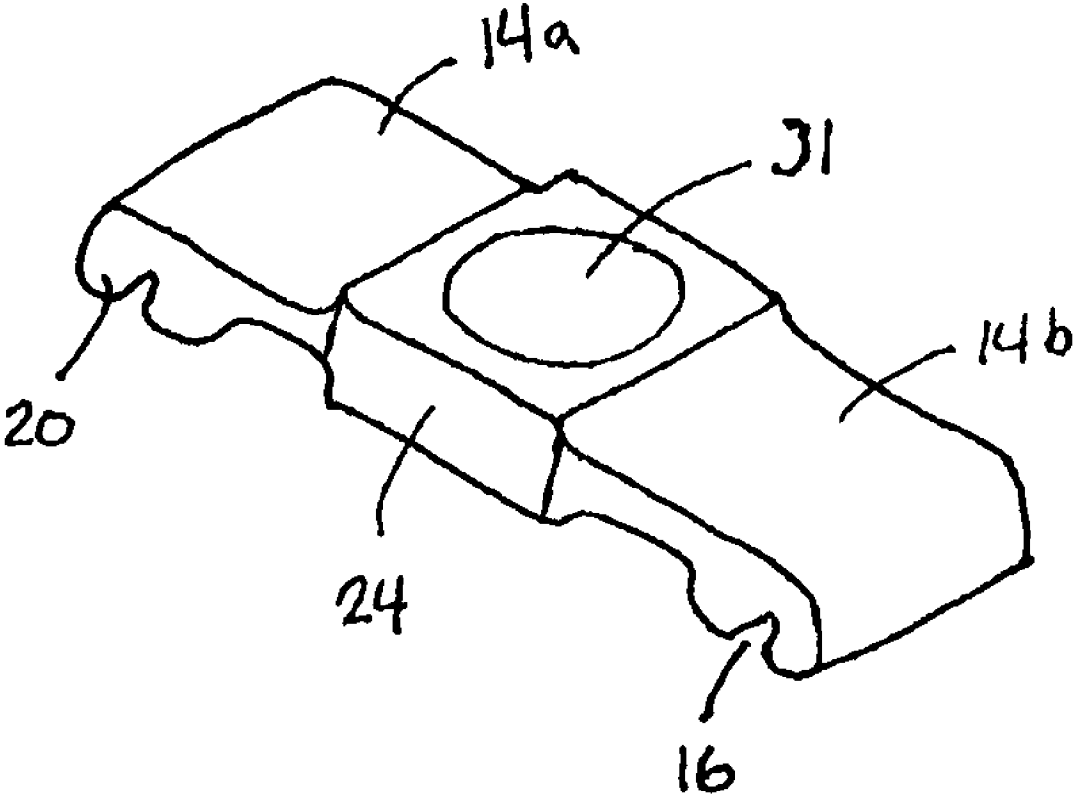
FIG. 5 illustrates a three dimensional view of an embodiment of the present screed clip minus the support member.

FIG. 5 illustrates a three dimensional view of an embodiment of the present screed clip 12 minus the support member 26 including the opposed arms 14(*a-b*) extending out from the base portion 24 having attachment mechanisms 16 within the arms 14(*a-b*). The base portion 24 is shown having an insert receiving section 31 for receiving and securing the support member 26 to the base portion 24. In one embodiment the insert receiving section 31 may be configured such that the support member 26 may rotate freely within the insert receiving section 31. However, the insert receiving section 31 may have various configurations for attaching the support member 26 to the base portion 24.

Figure 6:
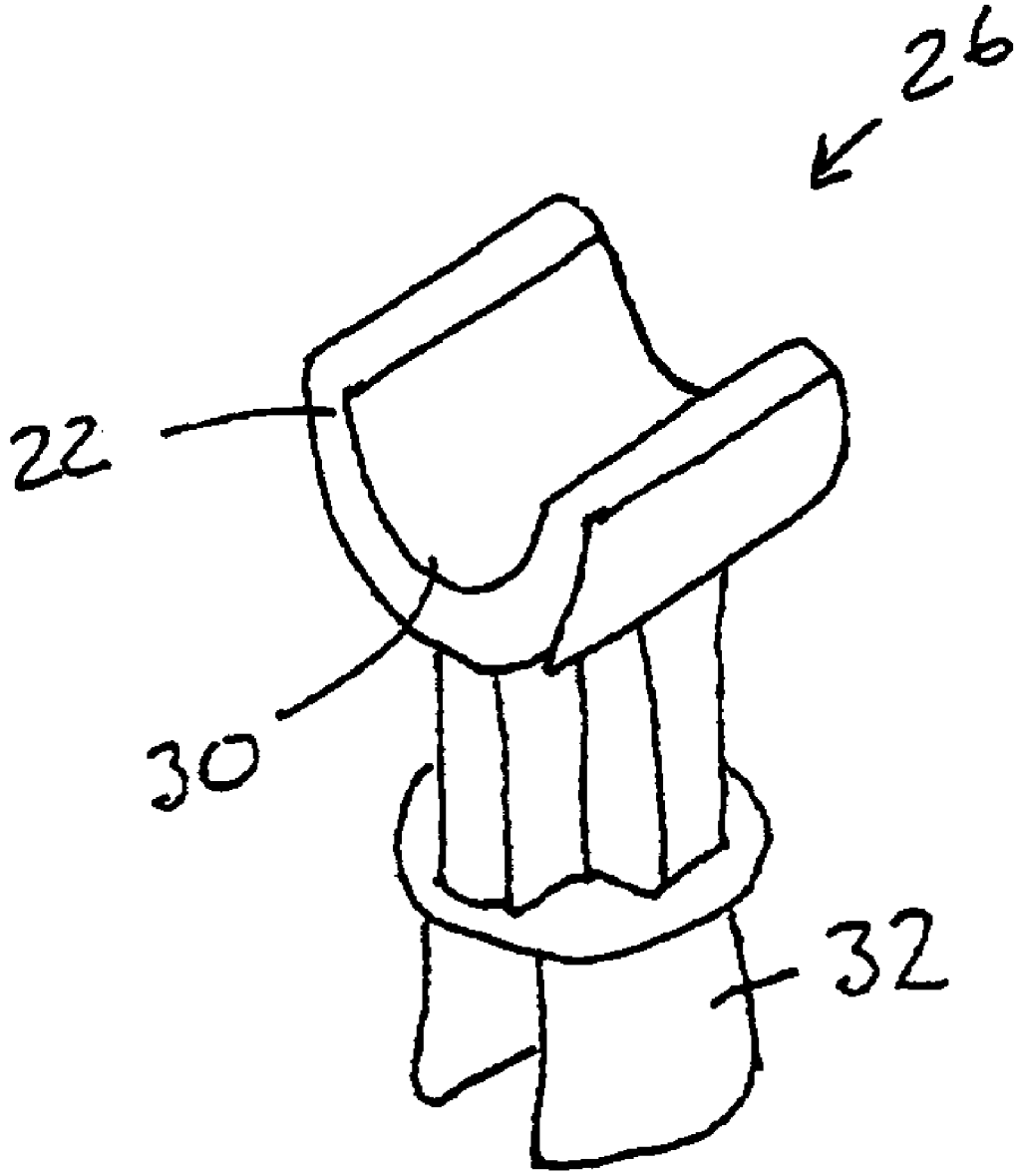
FIG. 6 is a three dimensional view of the support member including a slide portion.

FIG. 6 is a three dimensional view of the support member 26 including a slide portion 30 upon which the guide bar 28 rests and substantially parallel arms 22 extending from the slide portion 30 for restricting the lateral movement of the guide bar 28. The arms 22 may extend up to a length that is less than the circumference of the guide bar 28 such that only the guide bar 28 engages the screed.

Further shown in FIG. 6, is the embodiment comprising the support insert 32 which is operatively configured to fit within the within the insert receiving section 31. The support insert 32 may be rotatively configured within the within the insert receiving section 31 of the base portion 24 to accommodate the various angles in a building, such as roof angles. The support member 26 may also be configured to various lengths to accommodate different concrete thicknesses. For example, the support member may have a length to accommodate concrete thicknesses of 1.5, 2, and 2.5 inches. Of course other thickness are contemplated and a combination of lengths may be used together.

Figure 7:
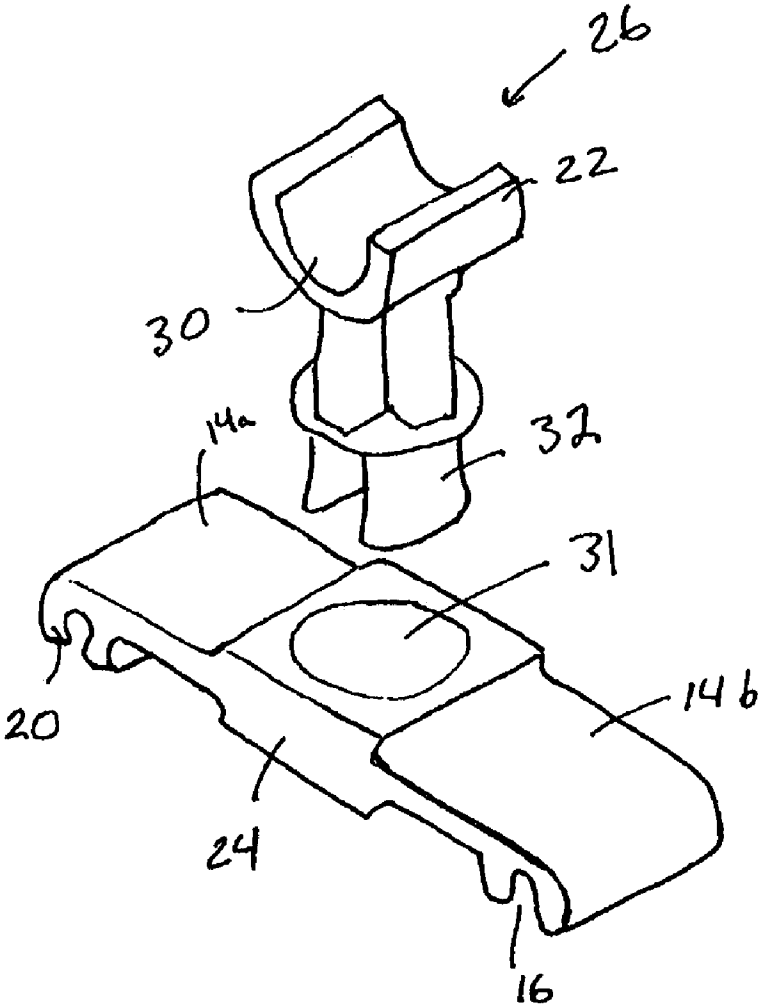
FIG. 7 is a line drawing showing the present screed clip including the support member and the base portion.

FIG. 7 is a line drawing showing the present screed clip 12 including the support member 26 and the base portion 24, wherein the support insert 32 of the support member 26 is operatively configured to fit within the insert receiving section 31 of the base portion 24.

While applicant has set forth embodiments as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

What is claimed is:

1. A screed clip for use in combination with a three dimensional panel formed from two opposed parallel welded wire grid mats, an insulating body arranged between the wire grid mats and associated web wires holding the wire grid mats at a distance from one another, the clip comprising;

a first opposed arm and a second opposed arm extending from a base portion;

a wire attachment mechanism located at an end portion of each arm for engaging a wire of the welded grid mat; and a support member extending up from the base portion, wherein the support member is shaped to engage a guide bar.

2. The clip of claim 1, further including an attachment mechanism located at the base portion for engaging the wire of the welded grid mat.

3. The clip of claim 1, wherein the wire attachment mechanism comprises a slotted groove for engaging the wire.

4. The clip of claim 3, wherein the slotted grove further includes a return formed at the base of the slotted groove for securely attaching the clip to the wire of the grid mat.

5. The clip of claim 1, wherein the support member includes a slide portion upon which the guide bar rests and substantially parallel arms extending from the slide portion for restricting the lateral movement of the guide bar.

6. The clip of claim 5, wherein the parallel arms extend up to a length that is less than the circumference of the guide bar such that only the guide engages the screed.

7. The clip of claim 1, the clip is formed from a resilient material selected from the group consisting of a polymeric material, metal, and combinations thereof.

8. The clip of claim 1, wherein the support member is comprised of varying lengths elevating the upper most portion of the guide bar to a height above the grid mat of between about 0.75 inches to about 3 inches.

9. The clip of claim 1, the attachment mechanisms are selected from the group consisting of friction fit notches, clips, biased members, hooked members, tensioned members and combinations thereof.

10. The clip of claim 1, wherein the attachment mechanisms are spaced apart from each other at intervals of about 2 inches.

11. The clip of claim 1, wherein the base portion includes an insert receiving section for receiving and securing the support member to the base portion.

12. The clip of claim 11, wherein the support member rotates within the insert receiving section, whereby the support section may rotate to accommodate various angles of a building structure.

13. A kit for screeding a cementitious coating with a screed applied to a three dimensional panel formed from two opposed parallel welded wire grid mats, an insulating body arranged between the wire grid mats and associated web wires holding the wire grid mats at a distance from one another comprising;

a guide bar;

a plurality of screed clips attached to the welded grid mat in series for supporting the guide bar throughout the length of the guide bar; and wherein the screed clip includes a first opposed arm and a second opposed arm extending from a base portion, a wire attachment mechanism located at an end portion of each arm for engaging a wire of the welded grid mat and a support member extending up from the base portion, wherein the support member is shaped to engage the guide bar.

14. The kit of claim 13, wherein the guide bar is formed from a fiber-reinforced polymer.

15. The kit of claim 14, wherein the guide bar has a diameter of about ⅜ of an inch.

16. The kit of claim 13, further including a plurality of guide bars each having their own respective series of screed clips for supporting the guide bar.

17. The kit of claim 13, further including an attachment mechanism located at the base portion for engaging the wire of the welded grid mat.

18. The kit of claim 13, wherein the wire attachment mechanism comprises a slotted groove for engaging the wire and the slotted grove further includes a return formed at the base of the slotted groove for securely attaching the clip to the wire of the grid mat.

19. The kit of claim 13, wherein the support member includes a slide portion upon which the guide bar rests and substantially parallel arms extending from the slide portion for restricting the lateral movement of the guide bar and the arms extending up to a length that is less than the circumference of the guide bar such that only the guide engages the screed.

20. The kit of claim 13, wherein the base portion of the screed clip includes an insert receiving section for receiving and securing the support member to the base portion.

21. The kit of claim 20, wherein the support section of the screed clip rotates within the insert receiving section, whereby the support member may be rotated to accommodate various angles of a building structure.

22. A method of screeding a cementitious coating with a screed applied to a three dimensional panel formed from two opposed parallel welded wire grid mats, an insulating body arranged between the wire grid mats and associated web wires holding the wire grid mats at a distance from one another comprising;

attaching to the welded grid mat a plurality of screed clips comprising a first opposed arm and a second opposed arm extending from a base portion, a wire attachment mechanism located at an end portion of each arm for engaging a wire of the welded grid mat and a support member extending up from the base portion, wherein the screed clips are attached in series;

inserting a guide bar through the plurality of screed clips attached in the series;

applying a cementitious coating to the panel; and screeding the cementitious coating applied to the panel to a finish and thickness as directed by the guide bars.

23. The method of claim 22, further including removing the guide bars after screeding the cementitious coating.

24. The method of claim 22, further including inserting the support member of the screed clip into an insert receiving section for receiving and securing the support member to the base portion.

25. The method of claim 24, further including rotating the support member within the insert receiving section, whereby the support member may be rotated to accommodate various angles of a building structure.

* * * * *